US006953346B2

(12) United States Patent
Downs et al.

(10) Patent No.: US 6,953,346 B2
(45) Date of Patent: Oct. 11, 2005

(54) METHOD AND APPARATUS FOR HIGH POWER SWITCHING

(75) Inventors: Henry Downs, Portland, ME (US); David B. Folsom, Casco, ME (US); Brian K. Pomerleau, Fairfield, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/733,440

(22) Filed: Dec. 12, 2003

(65) Prior Publication Data

US 2005/0130455 A1 Jun. 16, 2005

(51) Int. Cl.[7] ..... H01R 29/00
(52) U.S. Cl. ..... 439/52
(58) Field of Search ..... 439/52, 50–53, 439/578–585

(56) References Cited

U.S. PATENT DOCUMENTS 4,214,133 A * 7/1980 Wolford et al. ..... 200/19.21
4,255,734 A * 3/1981 Owen ..... 336/147
5,167,510 A 12/1992 Plummer ..... 439/52
6,307,289 B1 * 10/2001 Skala ..... 310/68 D

* cited by examiner

*Primary Examiner*—J. F. Duverne
(74) *Attorney, Agent, or Firm*—Baker & Hostetler LLP

(57) ABSTRACT

A high power switching matrix constructed using stacked housings of common rows and common columns joined together by thimble sections. The switching assembly of the switching matrix is isolated from the housing using insulators provided with rotary bearings in which the switching assembly is mounted. Servicing of the switching matrix and replacement of components parts is accomplished through disassembly of the modular components.

12 Claims, 3 Drawing Sheets

METHOD AND APPARATUS FOR HIGH POWER SWITCHING

FIELD OF THE INVENTION

The present invention relates generally to switching matrices. More particularly, the present invention relates to a compact high power switching matrix for connecting multiple transmitters and multiple antennas.

BACKGROUND OF THE INVENTION

In the field of radio frequency (RF) transmission, there is a need to permit variations in the connections between multiple existing transmitters and multiple existing antennas. By providing flexibility in such connections, different antenna characteristics can be selected at different times. To satisfy this need, numerous switching systems have been developed to improve such switching capabilities.

One such switching system is disclosed in U.S. Pat. No. 5,167,510 (Plummer), which issued Dec. 1, 1992, the disclosure of which is incorporated herein by reference. The switching matrix of this patent permits the connection of multiple transmitters and multiple antennas utilizing a plurality of crosspoint switch modules. Given the modular design of this crosspoint switch module, a matrix of any size can be easily constructed.

As the switching matrix of the U.S. Pat. No. 5,167,510 represents a considerable advancement over prior switching systems, efforts have been directed toward further improving this design. In particular, it is always desirable to reduce the labor required to install and service such a switch particularly for the replacement of consumable parts. Efforts have therefore been made toward to goal of reducing the cost of manufacturing, installing and servicing the switch matrix.

SUMMARY OF THE INVENTION

The foregoing desires are met, to a great extent, by the present invention, wherein in one aspect a high power switching matrix constructed using stacked housings of common rows and common columns joined together by thimble sections is provided. The switching assembly of the switching matrix is isolated from the housing using insulators provided with rotary bearings in which the switching assembly is mounted. Servicing of the switching matrix and replacement of components parts is accomplished through disassembly of the modular components.

In accordance with one aspect of the present invention, a switch matrix is provided having an electrically grounded housing. The electrically grounded housing has a first housing section with an input port for receiving a first feed line. The first housing section also contains a first switch head of each of a plurality of switch assemblies. A second housing section having an input port for receiving a second feed line is also provided in the switch matrix. The second housing section contains a second switch head of each of a plurality of switch assemblies. In the switch matrix, only one of the plurality of switch assemblies of the first and second housing sections is common. A hollow thimble section joins the first and second housing sections and encases a section of the common switch assembly. The common switch assembly includes a connecting conductor for providing a transmission path between the first and second switch heads of the common switch assembly. A first switching assembly insulator having a bearing assembly for receiving a first distal end of the connecting conductor and a second switching assembly insulator having a bearing assembly for receiving a second distal end of said connecting conductor provide isolation of the connecting conductor from the housing.

In accordance with another aspect of the present invention, a method of constructing a switch matrix is provided wherein a first switch assembly insulator having a bearing therein is connected between a first housing section and a first end of a first hollow thimble section. A first distal end of a first connecting conductor is placed into the bearing of the first switch assembly insulator and a bearing assembly of a second switch assembly insulator is placed on a second distal end of said first connecting conductor at a second end of said first hollow thimble section. The second end of the first hollow thimble section is connected to a second housing section with the second switch assembly insulator in between.

In accordance with yet another aspect of the present invention, and insulator plate for a switch matrix is provided having a plate with four equally spaced tabs projecting outward from the rim of the plate and a plurality of ports provided there through. A rotary bearing is disposed within the plate. The plate is composed of an insulating material.

In accordance with yet another aspect of the present invention, an insulator plate for a switch matrix is provided with a plate having a first and a second set of finger contacts mounted on opposing sides and electrically connected through the plate. A corona shield is provided around the first and second set of finger contacts.

In accordance with yet another aspect of the present invention, a method of replacing an insulator plate of a switch matrix is provided by detaching a thimble section from a first housing section of a switch matrix to free an insulator plate secured there between. The insulator plate is then rotated to release a plurality of tabs projecting outward from the rim of the plate from slots provided in the thimble section. The insulator plate is removed from between the housing section and the thimble section.

In accordance with yet another aspect of the present invention, a method of replacing an insulator plate of a switch matrix is provided by detaching a thimble section from a first housing section of a switch matrix to free an insulator plate secured there between. The insulator plate is rotated to release a plurality of tabs projecting outward from the rim of the plate from slots provided in the housing section. The insulator plate is removed from between the housing section and the thimble section.

In accordance with yet another aspect of the present invention, a switch matrix is provided having a first transmission direction means for directing an RF transmission from a first transmission line to a first antenna and for preventing RF transmission from the first transmission line to the first antenna. A second transmission direction means for directing an RF transmission from the first transmission line to a second antenna and for preventing RF transmission from the first transmission line to the second antenna is also provided in the switch matrix. The first and second transmission direction means are contained in a housing means. A first insulating means for isolating the first transmission direction means from the housing means has a first rotating means contained within the first insulating means for improving rotation of said first transmission direction means. A second insulating means for isolating the second transmission direction means from the housing has a second rotating means contained within the second insulating means for improving rotation of the second transmission direction means.

There has thus been outlined, rather broadly, certain aspects of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
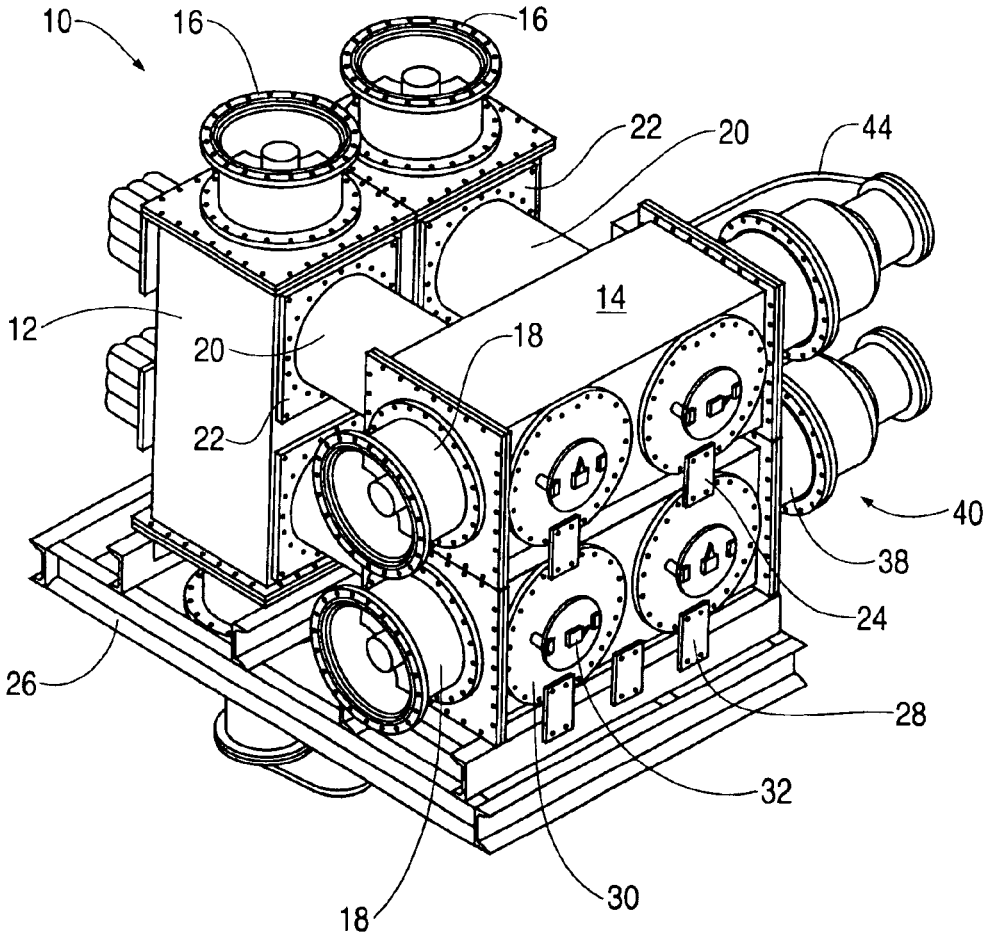
FIG. 1 is a perspective view of a switching matrix in accordance with a preferred embodiment of the present invention.

The invention will now be described with reference to the drawing figures, in which like reference numerals refer to like parts throughout. An embodiment in accordance with the present invention provides a high power switching matrix constructed using stacked housings of common rows and common columns. These common rows and common columns are joined together in an orthogonal arrangement by thimble sections. Switching assemblies of the switching matrix are contained within the housing and thimble sections and provide any-to-any connection of the input ports of the columns to the input ports of the rows. The switching assemblies are electrically isolated from the housing and thimble sections using insulators provided with rotary bearings in which the switching assembly is mounted. The rotary bearings provide for reduced friction rotation of the switching assembly thus allowing for the use of lower power, and lower cost, driver motors.

Servicing of the switching matrix and replacement of components parts is more readily accomplished as a result of the modular construction of the housing and arrangement of the components therein. Servicing of the switching assembly insulators is accomplished by separating the thimble sections from the housing sections and removing the insulators contained therebetween.

An embodiment of the present inventive apparatus is illustrated in FIG. 1 wherein a switch matrix 10 of the present invention is depicted. The switching matrix 10 is constructed from a plurality of rectangular box-shaped first housing sections 12 provided in columns which are connected to a plurality of rectangular box-shaped second housing sections 14 provided in rows. Each of the first housing sections 12 contains a port 16 mounted at a first open end for receiving a feed line which is preferably coaxial feed line. Similarly, each of the section housing sections 14 contains an input port 18 mounted at a first open end for receiving a feed line which is preferably a coaxial feed line.

In the embodiment depicted in FIG. 1, each housing section 12, 14 houses two switch heads, described below. Thus, in the exemplary two-by-two matrix of FIG. 1, two transmitters can connect to two antennas. It should be readily understood that the two-by-two arrangement is used for ease of understanding the inventive apparatus and method but that the invention is not limited thereto. It should be readily understood from the description that follows that a matrix of any size can be constructed using the techniques described herein.

Thimble sections 20 are provided to join one crosspoint location of a first housing section 12 to a crosspoint location of a second housing section 14. In a preferred embodiment, the thimble sections 20 are constructed of an aluminum or copper cylinder and the length of the thimble sections is selected to provide optimum electrical distance between the rows and columns to further maximize the isolation between adjacent switches. These thimble sections 20 are connected to the housing sections 12, 14 by means of a mounting plate and fasteners 22. Adjacent sections of the first housing sections 12 and adjacent sections of the second housing section 14 are joined to each other by mounting plates and fasteners 24. The housing sections are also secured to the base 26 of the switch matrix 10 using mounting plates and fasteners 28.

In the switching matrix of a preferred embodiment of the present invention, the feed ports of both the columns and rows are sixteen inches on center. This represents a significant improvement over prior switching matrices that require a distance of thirty to thirty-six inches on center for the feed ports. As should be readily understood, this provides for a more compact construction of the switch matrix.

Secured to the side of the second housing sections 14, at the location of each crosspoint, are mounting plates 30 which provide ready access to the switching assemblies contained therein for both installation and servicing. Secured to the mounting plates 30 are switch position indicators 32 the purpose and operation of which will be described below in connection with FIG. 3.

Figure 2:
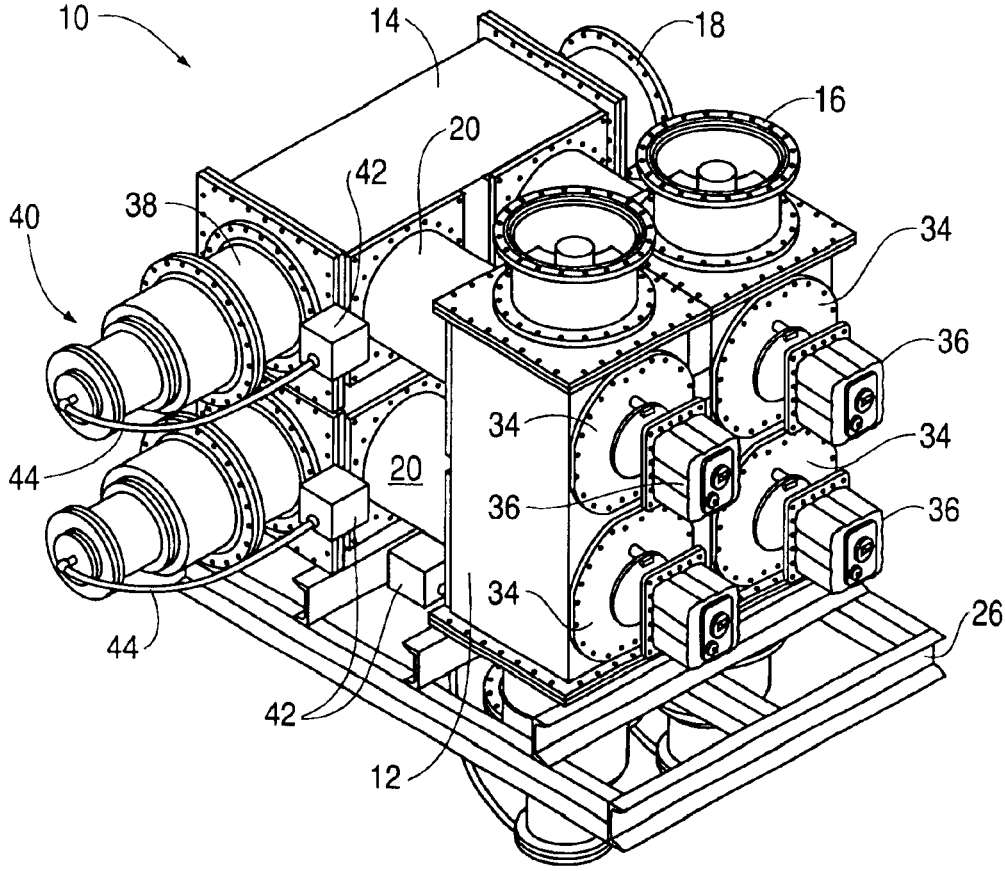
FIG. 2 is a perspective view of the switching matrix of FIG. 1 provided from an alternate perspective to show additional features of the invention.

Turning now to FIG. 2 the switch matrix of FIG. 1 is shown from an alternate angle allowing a view of additional features of the switch matrix. As depicted in this figure, mounted to the side of the first housing sections 12, at the location of each crosspoint, are mounting plates 34. Secured to the mounting plates 34 are driving motors 36 used to rotate the switching assemblies contained with the housings. As will be described below, the construction of the switch assemblies permits the use of smaller, lower horsepower, lower torque motors to drive the switching assemblies. In a preferred embodiment of the present invention, two horsepower motors are sufficient to operate the switch matrix.

Also depicted in FIG. 2 are ports 38 opposing the input ports 18. As depicted, a coaxial reducer and termination 40 is provided on each of the ports 38 and the coaxial reducers are connected to an isolation load 42 through a row terminator cable 44. The isolation load 42 is provided to balance out the load of the feed lines. In an exemplary embodiment of a seventy-five ohm matrix, the isolation load 42 would typically be a one hundred watt, seventy-five ohm load.

Figure 3:
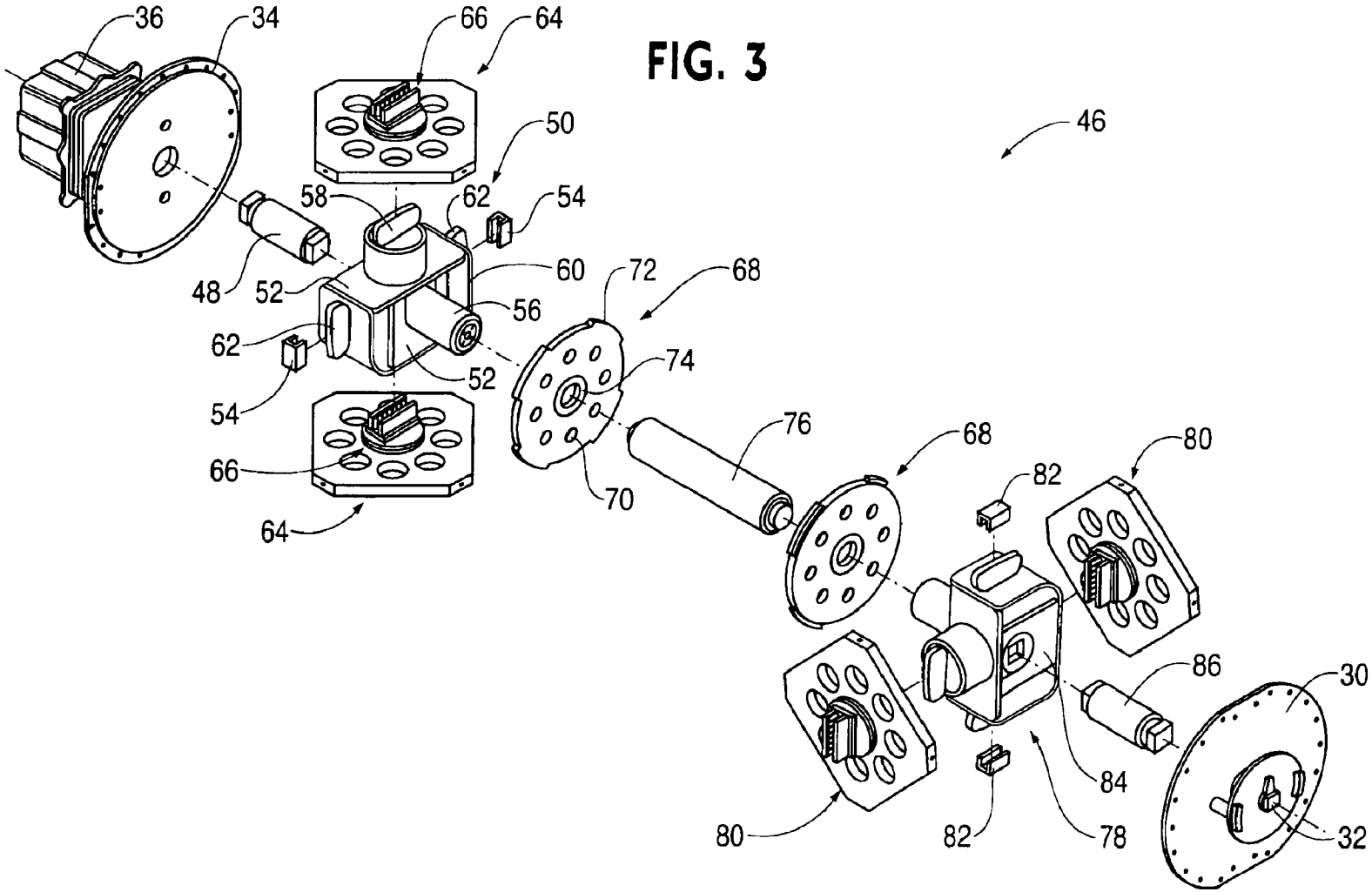
FIG. 3 is an exploded view of a switching assembly of the switching matrix of FIGS. 1 and 2.

Turning now to FIG. 3, a switching assembly 46 of the switch matrix will now be described. It should be understood that a switching assembly 46 is provided at each crosspoint of the switch matrix 10. Beginning at the driving motor 36 and moving to the right in the figure, the motor is mounted to the mounting plate 34 as described in connection with FIG. 2. A drive shaft 48 is connected at one distal end to the motor 36 through a hole in the mounting plate 34. At the other distal end of the drive shaft 48 is a switch head unit 50.

The switch head unit 50 is constructed of insulating plates 52 through which an L-shaped coaxial connector 56 is secured. Mounted at one end of the coaxial connector 54 is a switch blade connector 58. A U-shaped conductor 60, made from a highly conductive material such as copper, is secured to the first and second insulating plates 52 and have switch blade connectors 62 mounted on opposing sides.

Provided above and below the switch head 50 are insulators 64 which are preferably Teflon, which is a registered trademark of the DuPont company. Provided on each side of the insulators 64 are contact assemblies 66 which are designed to receive the switch blade contacts 58, 62 of the switch head. The contact assemblies include a plurality of opposing conductive fingers through which the switch blade contacts 58, 62 slide during operation. The contact assemblies also include corona shields which prevent the finger contacts from absorbing unwanted surrounding radiating energy within the housing unit. As oriented, the insulators 64 are oriented as they would be located in the first housing section 12 columns.

Grounding clips 54 are secured to the first housing section 12 and provide an electrical path to the housing section which is grounded. During operation, the switch blade contact 58 connected to the L-shaped coaxial connector 56 can be contained within the grounding clip, thereby grounding that switch head. It should be recognized that when the switch head is in this orientation the blade contacts 62 of the U-shaped conductor will be in contact with the finger contacts 66 on insulators 64. In this orientation, energy will be permitted to flow to or from the feed port 16 at the top of the column and bypass this crosspoint to the switch head below.

Alternatively, when oriented so that the switch blade connector 58 is rotated to be within the contact fingers of the uppermost insulator, energy to or from the feed port 16 of that column will be directed through the L-shaped conductor 56. In this orientation, the U-shaped conductor 60 will be grounded to the housing 12 and will thereby provide a shield against radiating energy passing to the switch head below.

A pair of insulators 68 are provided in which the switch assembly 46 rotates and which provide electrical isolation of the switch assembly 46 from the housing and thimble sections. The insulators are provided with a number of ports 70 through which air can pass. The insulators 68 in the preferred embodiment of the invention are round and are provided with four equally spaced tabs 72 around the rim of the insulator. The tabs 72 are designed to be held between the the thimble section 20 and the adjacent housing section 12, 14, to accomplish this, four recesses are provided in the housing section, one for each tab 72, and into which each tab 72 fits. Four slots are provided in the housing, one adjacent each of the recesses, to allow removal of the insulator 68 as described below.

The insulators 68 are provided with bearings 74 into which the L-shaped conductor 56 is connected on one side of the insulator 68 and a center conductor 76 is connected on the other side of the insulator 68. In a preferred embodiment of the invention, the bearings are rotary bearings. As can be readily appreciated, the use of bearings in the insulators forms a dual bearing arrangement which support to switch assembly 46 and allow it to turn freely. In a preferred embodiment of the invention, the switching assembly is balanced so that once released from the finger contacts and grounding clips, the switching assembly 46 will continue to rotate irrespective of its orientation. This construction substantially reduces the power and torque requirements of the motor and thereby permits the use of smaller, lower cost motors.

To remove the insulator 68, such as during servicing, the mounting plate 34, 30 is removed from the housing 12, 14 to provide access to the switch head 50, 78. The switch head 50, 78 is then removed from the housing 12,14 through the opening in the housing 12, 14 uncovered by removing the mounting plate 34, 30. The fasteners holding the thimble section 20 to the housing 12, 14 are loosened and the insulator 68 is rotated to align the tabs 72 with slots in the housing. The insulator 68 can then be removed through the opening in the housing 12, 14.

As shown in FIG. 3, a second switch head 78, identical to the first switch head 50 is provided but is secured to the center conductor 76 in an orthogonal orientation. Insulators 80 and grounding clips 82 similar to those provided for the first switch head 50 are also provided but in an orthogonal orientation.

Depicted as part of switch head 78 is and insulator plate 84 having a slotted recess for receiving a squared off end of a drive shaft 86. The drive shaft 86 is used to drive the pointer 32 indicating the orientation of the switch assembly 46 inside the housing. It will be readily appreciated that the drive shaft 48 connected to drive motor 36 is also secured within a similar recess of an insulator plate of the switch head 50.

From the construction of the switch assemblies 46 which has now been described, it should therefore be readily appreciated how the switch matrix 10 can accomplish the any-to-any connection of transmitters to antennas. It will also be readily appreciated how the construction of the switch matrix of the present invention permits a more compact design which can be shipped in pieces, constructed on location and easily serviced.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A switch matrix comprising:

an electrically grounded housing having:

a first housing section having an input port for receiving a first feed line, said first housing section containing a first switch head of each of a plurality of switch assemblies;

a second housing section having an input port for receiving a second feed line, said second housing section containing a second switch head of each of a plurality of switch assemblies;

wherein only one of said plurality of switch assemblies of said first and second housing sections is common;

a hollow thimble section joining said first and second housing sections and encasing a section of said common switch assembly;

said common switch assembly comprising:

a connecting conductor for providing a transmission path between said first and second switch heads of said common switch assembly;

a first switching assembly insulator having a bearing assembly for receiving a first distal end of said connecting conductor;

a second switching assembly insulator having a bearing assembly for receiving a second distal end of said connecting conductor; and said first and second switching assembly insulators providing isolation of the connecting conductor from said housing.

2. The switch matrix of claim 1, wherein said bearings of said switching assembly insulators are rotary bearings.

3. The switch matrix of claim 1, further comprising:

a plurality of indicators mounted on the outside of said housing to indicate the orientation of the switch assembly, each of said indicators mechanically joined to a separate one of said switch heads contained in said second housing section.

4. The switch matrix of claim 1, further comprising:

a first switch blade contact connected to one end of a conductor line of said switch head, a second end of said conductor line of said switch head connected to the connecting conductor; and a second and third switch blade contact of said switch head connected to a high conductivity plate, said second and third switch blade contacts and said high conductivity plate being electrically isolated from said conductor line of said switch head.

5. The switch matrix of claim 4, further comprising:

a separate switch head insulator plate provided between each of said first plurality of switch heads in said first housing section; and each of said switch head insulator plates containing a first set of finger contacts for engaging said switch blade contacts of a first of adjacent switch heads and a second set of finger contacts for engaging said switch blade contacts of a second of adjacent switch heads, said switch head insulator plates providing isolation of said finger contacts from said housing.

6. The switch matrix of claim 5, further comprising:

a corona shield provided around said first set of finger contacts of each switch head insulator plate; and a corona shield provided around said second set of finger contacts of each switch head insulator plate.

7. The switch matrix of claim 5, further comprising:

a grounding clip connected to said first housing for engaging said switch blade contacts of said switch head to provide a ground path for said conductor line of said switch head or said high conductivity plate of said switch head.

8. The switch matrix of claim 7, further comprising a motor for rotating said common switch assembly.

9. The switch matrix of claim 8 further comprising a drive shaft connected at one distal end to an insulating end plate of the first switch head of said common switch assembly and at the other distal end to the motor.

10. The switch matrix of claim 1, wherein said first switching assembly insulator is connected between said thimble section and said first housing section and said second insulator is connected between said thimble section and said second housing section.

11. An insulator plate for a switch matrix, comprising:

a circular plate having four equally spaced tabs projecting outward from the rim of the plate and a plurality of ports provided there through;

having a first and a second set of finger contacts mounted on opposing sides and electrically connected through said plate;

a corona shield provided around said first and second set of finger contacts;

a rotary bearing disposed within said plate; and wherein said plate is composed of an insulating material.

12. The insulator plate of claim 11, wherein said plate is composed of Teflon.

* * * * *